United States Patent [19]

Blair

[11] Patent Number: 4,778,960

[45] Date of Patent: Oct. 18, 1988

[54] FLOATING OPERATING AND RELEASE POINT SWITCH

[75] Inventor: James Blair, St. Charles, Ill.

[73] Assignee: Saint Switch, Incorporated, St. Charles, Ill.

[21] Appl. No.: 91,384

[22] Filed: Aug. 31, 1987

Related U.S. Application Data

[63] Continuation-in-part of Ser. No. 903,760, Sep. 4, 1986, abandoned, which is a continuation-in-part of Ser. No. 751,627, Jul. 2, 1985, abandoned.

[51] Int. Cl.[4] ..... H01H 13/54

[52] U.S. Cl. ..... 200/153 V; 200/159 R; 200/340

[58] Field of Search ..... 200/153 V, 340, 276, 200/243, 165, 159 R, 277, 249

[56] References Cited

U.S. PATENT DOCUMENTS

| | | | |
|---|---|---|---|
| 1,080,058 | 12/1913 | Hart | 200/159 R |
| 3,624,330 | 11/1971 | Bognar et al. | 200/153 V |
| 3,680,022 | 7/1972 | Bright | 200/153 V |
| 4,027,122 | 5/1977 | Bevacqua | 200/77 |

FOREIGN PATENT DOCUMENTS

| | | | |
|---|---|---|---|
| 1301989 | 7/1962 | France | 200/159 R |
| 1569544 | 5/1967 | France | 200/340 |

*Primary Examiner*—Renee S. Luebke

*Attorney, Agent, or Firm*—Wood, Dalton, Phillips, Mason & Rowe

[57] ABSTRACT

A switch actuator providing a floating operating and release point switch including a base, a plunger having an exposed operating end mounted for movement on the base, a mount for relatively movable switch contacts on the base, and a friction piece normally grasping the plunger so as to be movable therewith and yet be relatively movable with respect to the plunger when movement of the friction piece is resisted. The friction piece is oriented with respect to the mount such that movement of the friction piece may effect relative movement between relatively movable switch contacts mounted to the base.

12 Claims, 4 Drawing Sheets

FLOATING OPERATING AND RELEASE POINT SWITCH

CROSS REFERENCE

This application is a continuation-in-part of my commonly assigned, earlier filed application Ser. No. 903,760, filed Sept. 4, 1986 which is a continuation-in-part of Ser. No. 751,627, filed July 2, 1985, both bearing the same title as the instant application and now abandoned.

FIELD OF THE INVENTION

The present invention relates in general to switches of all designs in which overtravel is present, either occurring within the switch itself or occurring in a part of an actuating mechanism which is attached to the switch. It also relates to switches which require pretravel to provide for adjustment at the time of installation. The present invention can control or eliminate the pretravel, thereby making the switch transfer the circuit within the actuation movement of the operating differential of the switch. In particular, the invention relates to switches in the category of door lock switches, limit switches and security switch applications.

BACKGROUND OF THE INVENTION

In the field of switches, the term "pretravel" refers to the extent of downward movement of a plunger prior to the point at which an electrical circuit is transferred. The point at which the electrical circuit is transferred during the actuating movement of the plunger is the "operating point". The "release point" is the point at which the circuit is transferred back to its original state during return movement of the plunger. The distance between the operating point and the release point is termed the "movement differential". "Overtravel" is the distance that the plunger may move after the circuit is transferred at the operating or release point.

Snap action switches of the type used as limit switches typically have a characteriestic of operation as shown in FIG. 1. In FIG. 1 a plot is made of the force versus travel of the plunger or other actuator which is used to activate the snap action switch mechanism. Such snap action switches exhibit fixed but separate operating and release points, while butting contact switches exhibit the same fixed operating and release point.

As illustrated in FIG. 1, a plunger of a prior art limit switch first must move a pretravel distance 10 before reaching an operating point 16 of the switch. The switch may continue to receive actuating force so that its plunger moves into the overtravel region of the curve indicated as 14. The overtravel is the distance the plunger may move if it continues to receive an increasing actuating force after the operating point 16 is reached. Upon release, as the plunger begins to return to the original position to revise the switch condition, the release point 12 is reached. Movement differential is the difference between operating point 16 and release point 12.

In the prior art switches, the switch design inherently requires that actuating plunger travel must be the same as the return plunger travel (movement differential plus overtravel) before the switch will transfer the circuit to the original position. This means that a fixed operating point and a fixed release point, as the points 16 and 12, are determined for a given switch and do not vary. It further means that the actuation device or the switch mounting or both must be designed to allow for manufacturing tolerances in the involved apparatus components and still provide sufficient movement so that plunger travel through the operating point into the overtravel region is present to ensure that the switch will change states each time it is actuated. In many instances the attainment of these relations is complicated by the fact that normal manufacturing tolerances alone can be greater than the total travel (movement differential plus maximum permitted overtravel) of the switch thereby requiring the use of expensive and complicated mounting bracketry.

The present invention is directed to overcoming one or more of the above problems.

SUMMARY OF THE INVENTION

The present invention involves a floating operating and release point switch with a housing including at least first and second relatively movable electrical contacts. A frictional piece is associated with a movable one of the contacts within the housing. A plunger is in frictional but slidable, engagement with the friction member so as to normally move the friction piece and the movable contact with the plunger but allow relative movement between the plunger and the friction piece when movement of the latter or the movable contact is resisted. The plunger is at least partially contained in the housing.

The present invention of a novel floating operating and release point switch overcomes the problems in the prior art by providing a switch of the type that may seek new operating and release points with each actuation and release of the plunger. This allows the switch to utilize a movement differential to actuate or deactuate the circuit rather than cause actuation or deactuation at respective absolute positions. Any actuating deactuating movement equal to or greater than the differential movement will cause the switch to change states. The switch will revert to its initial state immediately upon initiation of plunger return movement in a normally open butting contact switch, or will begin to return to its initial state in the case of a double throw or snap action switch, which initial state will be reached when the movement differential distance has been traveled. In other words, any overtravel distance traveled upon actuation from the initial state of the switch is not traveled preliminary to reversion to (or toward) the inital state upon switch deactuation. The differential movement for actuation is fixed while the point along a force travel curve at which actuation may begin is variable. Concern for manufacturing mounting, and actuator movement tolerances are thus eliminated.

BRIEF DESCRIPTION OF THE DRAWINGS

The features of the present invention which are believed to be novel are set forth with particularity in the appended claims. The invention together with further objects and advantages may best be understood by reference to the following description taken in conjunction with the accompanying drawings, in the several figures of which like reference numerals identify like elements, and in which:

DETAILED DESCRIPTION OF THE PREFERRED EMBODIMENTS

Figure 1:
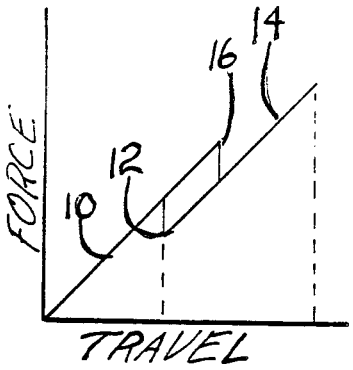
Fig 1 PRIOR ART
FIG. 1 is a graph of force versus travel for a typical prior art snap action switch.
Figure 2:
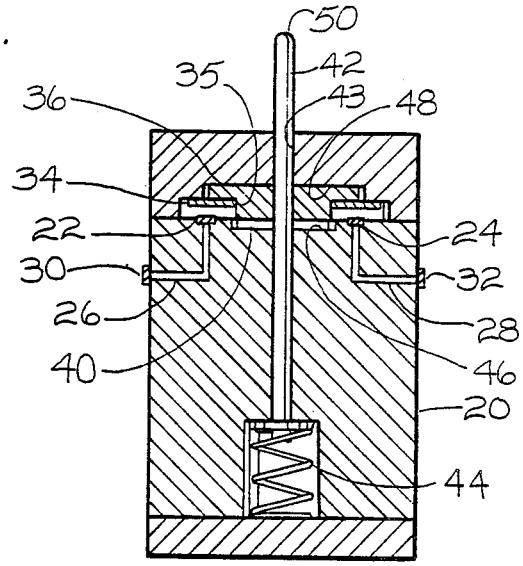
FIG. 2 is a cross-sectional side view of the novel floating release point switch.

A cross-sectional view of one embodiment of a novel floating operating and release point switch is shown in FIG. 2. A housing 20 is provided and may be manufactured in any number of sections depending upon the configuration of the housing 20. The housing 20 may also take on any one of the number of configurations depending upon its application. Contained within the housing 20 are first and second electrical contacts 22 and 24 although those skilled in the art will recognize that more than two contacts may be desirable in some uses. The electrical contacts 22, 24 are connected by electrical conductors 26 and 28 to conventional terminals shown schematically at 30 and 32 on the outside of the housing 20, respectively. The electrical contacts 22, 24, the terminals 30, 32 and the interconnecting electrical conductors 26, 28, may be oriented in the housing 20 and constructed according to well-known techniques in the art.

Figure 3:
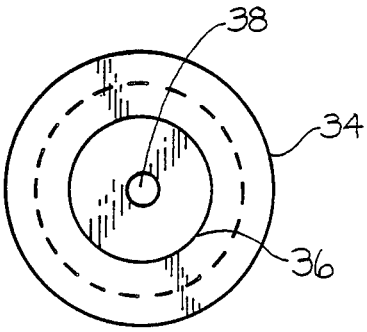
FIG. 3 is a top view of a contact member and a friction piece used in the FIG. 2 switch.

A contact 34 (FIGS. 2 and 3) is used to electrically interconnect the first and second electrical contacts 22 and 24. As shown in FIG. 3 the contact 34 is constructed from a circular brass washer having a central circular aperture 35. Alternatively, the circular washer may be formed from any other conductive material. A friction piece 36 is attached to the contact 34. The friction piece 36 in the preferred embodiment is formed of Teflon, nylon or similar material for wear resistance and is partially force fitted within the aperture 35 of the contact member 34. The friction piece 36 has a substantially central aperture 38. Other suitable configurations and materials could be used for constructing and assembling the contact 34 and the friction piece 36. For example, in an alternative embodiment the contact member 34 and frictional member 36 could be constructed as one piece.

The contact 34 and the friction piece 36 are contained within a cavity 40 in the housing 20 of whose opposed walls thereby define, along with the contacts 22, 24, the limits of travel of the contact 34 and friction piece 36.

A plunger 42 whose outer diameter is slightly greater than the diameter of the aperture 38 in the friction piece 36 extends through the aperture 38. Because of the difference in diameters, the friction piece 36 will grasp the plunger 42 to move therewith except when such movement is resisted. When that occurs, the friction piece 36 will slip on the plunger 42.

The plunger 42 is biased toward a non actuated position by a spring 44 as shown in FIG. 2 of the drawings and is reciprocally received and may extend from a bore 43 in the housing 20 a distance to be determined by the application for which the switch is used.

Figure 4A:
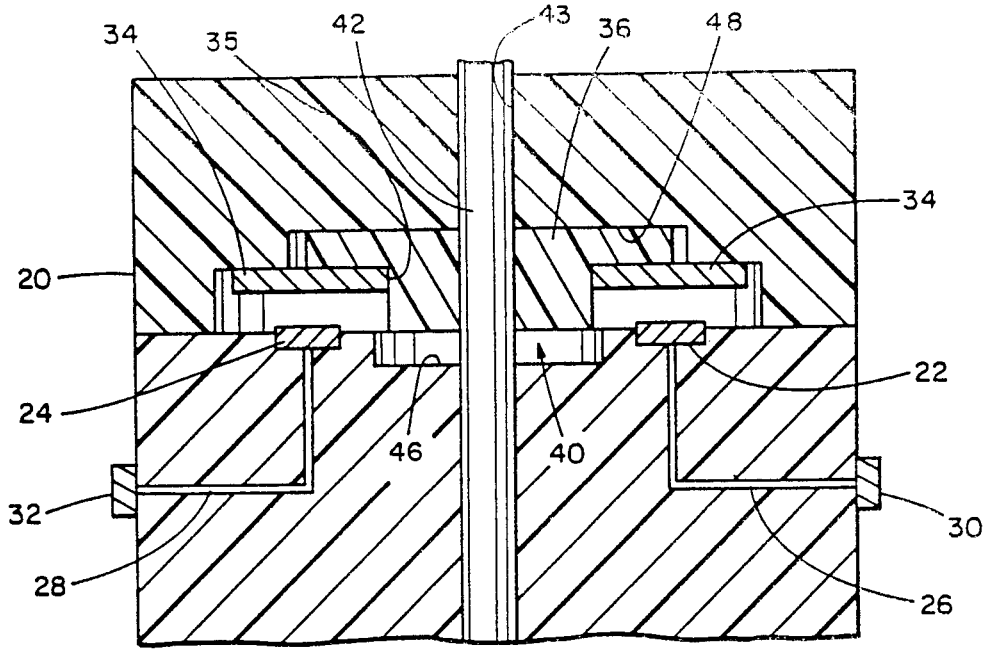
FIGS. 4A and 4B are partial cross-sectional side views showing the operation of the contact and friction piece depicted in FIG. 3.
Figure 4B:
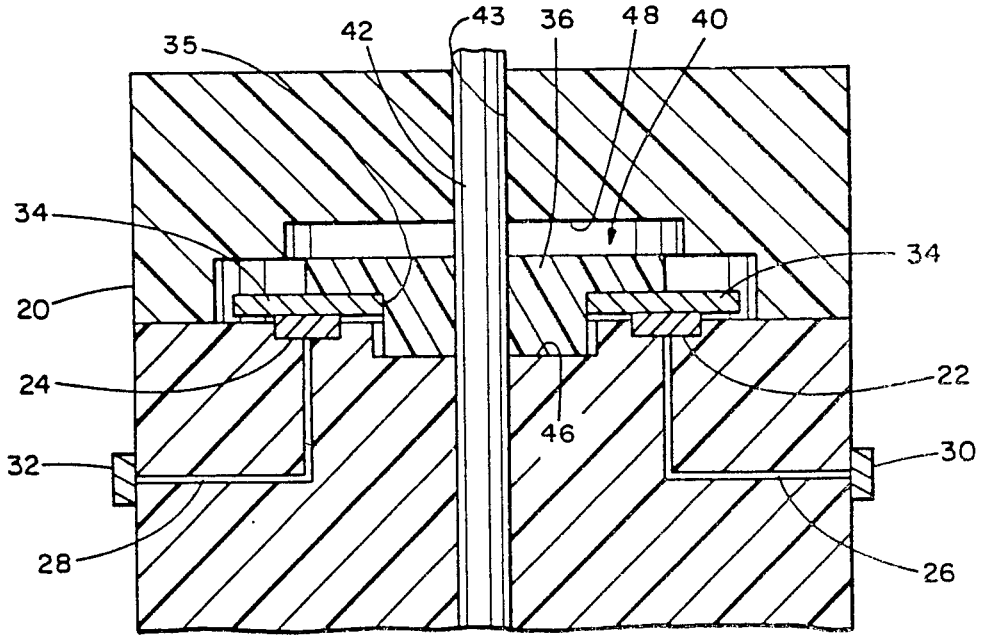

FIGS. 4A and 4B illustrate the relative positions of the contact 34 and friction piece 36 when the plunger 42 is in a non actuated position (FIG. 4A) and in one of many possible actuated positions (FIG. 4B). As noted previously, the plunger 42 is frictionally grasped in the aperture 38 of the friction piece 36 such that, when the plunger 42 is moved by the application to or release of force from its exposed end 50, the friction piece 36 will move with the plunger 42 until it is stopped by engagement with the wall 48 or by engagement of the contact 34 with the contacts 22, 24. Once movement is stopped, the plunger 42 then slips within the aperture 38 of the friction piece 36. The distance the plunger 42 moves after the friction piece 36 stops when the plunger 42 is moved toward an actuated position is the overtravel distance.

In the non actuated position shown in FIG. 4A, the contact 34 is not in electrical connection with the electrical contacts 22 and 24. Conversely, in the actuated position shown in FIG. 4B, the contact 34 established an electrical path between the electrical contacts 22 and 24. Importantly, the plunger 42 can continue to travel even after the contact 34 and the frictional piece 36 have reached their limits of travel. This is the case whether the plunger 42 is moving up or down as viewed in the drawings. Yet the amount of movement required to open or close the switch remains unchanged.

FIGS. 5A through 5E illustrate the sequence of operation for the novel switch. This method of establishing and breaking electrical connections between electrical contacts includes the steps of:

moving the plunger 42 into the housing 20 by applying an actuating force on the end 50 of the plunger 42;

moving the friction piece 36 with the plunger 42, the frictional member 36 being contained within the cavity 40 of the housing 20, by gripping the plunger 42 with the friction piece 36;

halting movement of the friction piece 36 upon establishing electrical contact between the contact 34 and the electrical contacts 22 and 24 which occurs when such contacts engage and which thereby defines the operating point of the switch;

continuing movement of the plunger 42 while slipping the friction piece 36 on the plunger 42;

moving the plunger 42 out of the housing 20 upon the release of the actuating force on the end 50 of the plunger 42; and moving the friction piece 36 with the plunger 42 during the movement of the plunger 42 out of the housing 20 to open the electrical contacts and thereby define the release point of the switch.

Figure 5A:
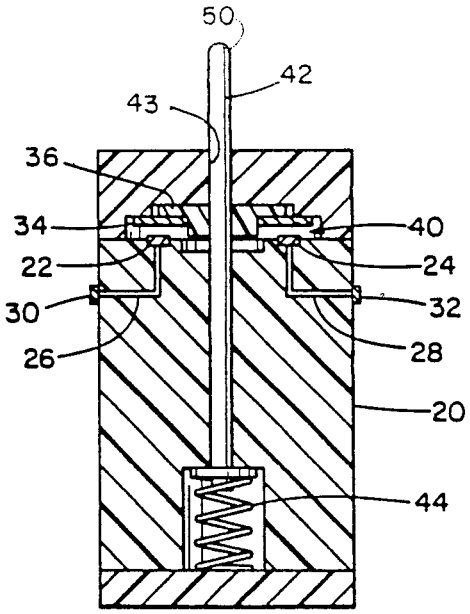
FIG. 5A through 5E are cross-sectional veiws of the novel switch illustrating the sequence of motion during operation of the switch.
Figure 5B:
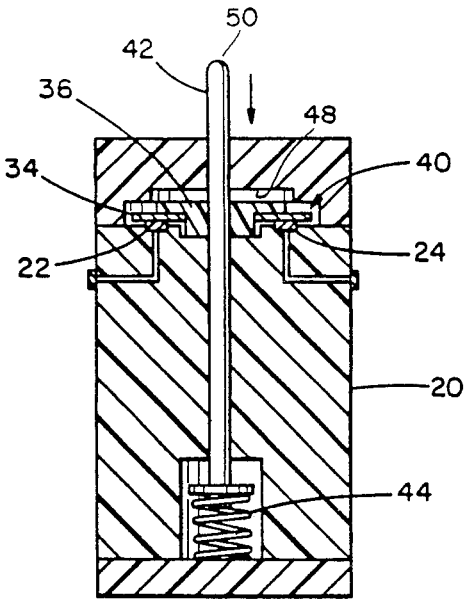
Figure 5C:
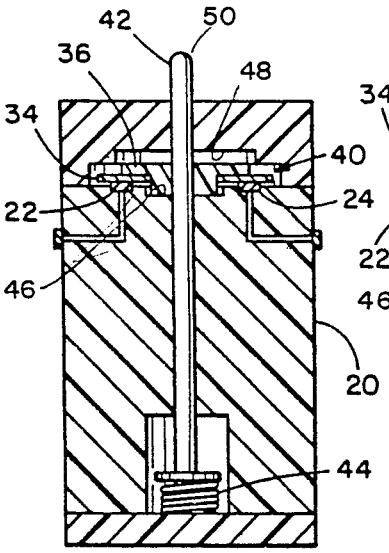

FIG. 5A shows the plunger 42 extended fully outward with the contact 34 spaced from the electrical contacts 22 and 24. The plunger 24 is in a free position which no actuating force applied to it other than the biasing force of the spring 44. As shown in FIG. 5B as the plunger 42 is moved inward by an actuating force, the contact 34 carried by the friction piece 36 moves away from the wall 48 and ultimately makes an electrical connection with the electrical contacts 22 and 24 at the operating point of the switch. The plunger 42 may continue to move inward through the overtravel distance until as shown in FIG. 5C the plunger 42 reaches it limit of inward travel. While the plunger 42 continues to move, the friction piece 36 slips on the plunger 42.

Figure 5D:
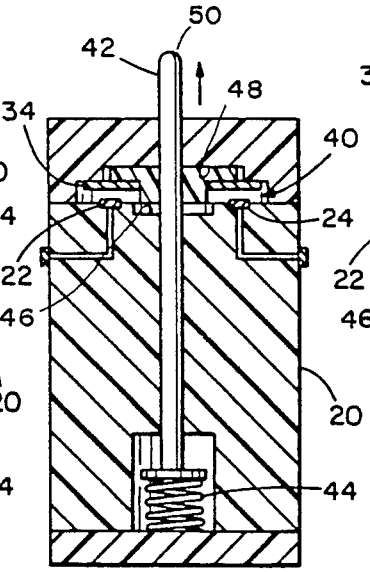
Figure 5E:
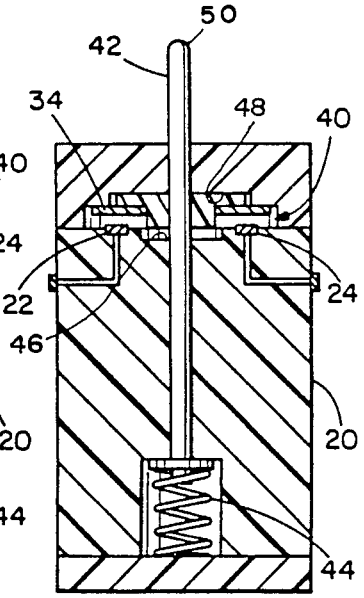

In FIG. 5D the plunger 42, as the actuating force is released, begins to move outward with the friction piece 36 thereby carrying the contact 34. The contact 34 and friction piece 36 halt movement upon engagement with the wall 48 of the cavity 40. The plunger 42 may continue to move outward through a return travel distance, sliding in the aperture 38 in the friction piece 36 until, as shown in FIG. 5E, the plunger 42 has moved completely outward to place the switch in the original state or the free position.

In use, the plunger end 50 typically will be in constant contact with an actuator mechanism (not shown) and may be installed and adjusted against the actuator mechanism so as to reduce the amount of overtravel designed into the switch. As the actuator mechanism moves to close the switch, the switch circuit is transferred at the operating point as described above and shown in FIG. 5B. However, as soon as the actuator mechanism allows reverse movement of the plunger 42 under bias of the spring 44 the circuit will immediately initiate a return to its original state. If the plunger 42 is permitted to continue to move after reaching the release point (which in this embodiment is reached immediately upon initiation of outward movement of the plunger 42), on the next actuation, the circuit will transfer after movement equal to the pretravel distance of the switch, with any additional plunger movement continuing into the overtravel area. To the extent that the plunger 42 has traveled into the overtravel area it need not return any distance to reach the release point, and if the return movement of the plunger 42 is not stopped short of engagement of the friction piece 36 with the wall 48, on the next actuation, the plunger 42 must again travel the pretravel distance to reach the operating point.

The switch may also be used with an actuator which does not remain in constant contact with the switch plunger. Since the switch is in a free position as shown in FIG. 5A and 5E with no force applied to the plunger 42, it will transfer the circuit upon the requisite inward movement of the plunger after being engaged by such actuation, and upon release of the actuating pressure allowing the plunger to return outward, immediately release the switch to its original state.

Figure 6:
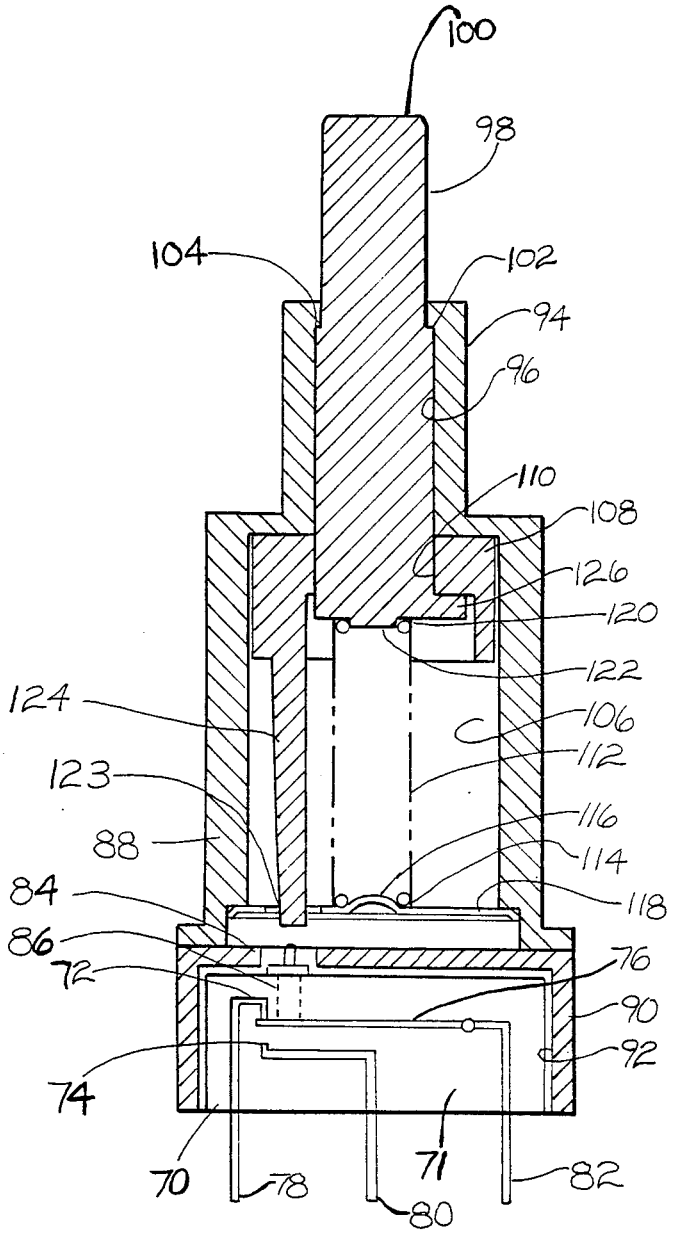
FIG. 6 illustrates a modified embodiment of the invention.

A modified embodiment of the invention is illustrated in FIG. 6. In the embodiment of FIG. 6, the principles of the invention are intended to be applied to a conventional micro or limit switch, generally designated 70. The micro switch 70 in the example shown is of conventional construction and includes a housing 71, a normally closed contact 72, a normally open contact 74 and a movable contact 76. The contact 72, 74 and 76 are respectively connected to external terminals 78, 80 and 82, respectively.

Externally of the micro switch 70, the same is provided with a plunger or actuator 84 which by means of a connection shown schematically at 86 is operative to move the movable contact 76 between electrical contact with the normally closed contact 72 and the normally open contact 74.

The switch actuator of FIG. 6 includes a base 88 fitted at one end with a switch housing 90 having an internal cavity 92 for receipt of the switch 70. Any suitable means may be utilized to mount and locate the switch 70 within the cavity 92 in the switch housing 90.

The opposite end of the base 88 is provided with an externally threaded bushing 94 having an interior guide bore 96 which slidably receives a plunger 98. An end 100 of the plunger extends from the base 88 and is adapted to be engaged with a mechanical actuator. Movement of the plunger 98 out of the base 88 is restrained by interengaging shoulders 102 and 104 respectively on the plunger 98 and the bore 96.

Within the base 88, there is an internal cavity 106. A friction piece 108, which may be formed of one of the materials identified previously in connection with the description of the friction piece 36, is provided. The friction piece includes an interior bore or aperture 110 which is impaled by the plunger 98. The relationship of diameters of the plunger 98 and the bore 110 is the same as mentioned previously in connection with the aperture 38 and the plunger 42. As a consequence, when the plunger 98 is moved in either direction within the base 88, the friction piece 108 will move with it by frictional engagement therewith unless, of course, its movement is restrained. In that case, relative movement between the plunger 98 and the friction piece 108 will obtain.

A compression coil spring 112 is located within the cavity 106. One end 114 of the spring 112 may be mounted on a dimple 116 in a closure 118 for the cavity 106 while the opposite end 120 extends to surround a dimple 122 on the end of the plunger 98 opposite the actuating end 100. As a consequence, the plunger 98 is biased by the spring 112 to the position illustrated in FIG. 6 but may move downwardly against the bias of such spring.

The closure 118, at a location in alignment with the plunger 84 for the switch 70, includes an opening 123. An elongated finger 124 integral with the friction piece 108 extends axially within the cavity 108 to emerge from the same through the opening 123 in a position to abut the plunger 84 of the switch 70.

The construction is basically completed by the provision of a radially directed stop 126 on the plunger at its end remote from the actuating end 100 which may engage the underside of the friction piece 108 to cause the latter to move with the former when the plunger 98 is moving in the return direction and the finger 126 engages the friction piece 108.

In this embodiment of the invention, operation is generally the same as described previously. However, it should be noted that in the case of this embodiment, the operating point and release point of the system may not be the same, the difference being dependent upon the construction of the switch 70.

In addition, it should be noted that the fitting of the friction piece 108 to the plunger 98 must be sufficiently tight that any spring force that may ultimately be communicated to the friction piece 108 from the switch 70 as, for example, via spring force in the movable contact 76 applied to the finger 124 via the actuator 84 when the two are in contact, is insufficient to effect relative movement between the friction piece 108 and the actuator 98.

Thus, not only does the embodiment of FIG. 6 maintain all of the advantages provided by the first described embodiment of the invention, it further permits the use of the principles of the invention with already existent switches simply by applying the actuator of the present invention to the actuator of a conventional switch.

The invention is not limited to the particular details of the apparatus and method depicted and other modifications and applications are contemplated. Certain other changes may be made in the above described apparatus and method without departing from the true spirit and scope of the invention herein involved. It will be readily obvious that numerous configurations of the parts and number of electrical contacts are possible utilizing the spirit of this invention. For example, the invention could be embodied in a snap action type switch, or in a switch with multipoles, or in a switch with sealed or unsealed housing. It is intended, therefore, that the subject matter in the above depiction shall be interpreted as illustrative and not in a limiting sense.

What is claimed is:

1. A floating operating and release point switch assembly comprising:

means for providing a housing;

at least first and second relatively movable electrical contacts contained within said housing means;

movable means for effecting relative movement between said first and second electrical contact to alter the state of said switch assembly; and means for actuating said movable means including an actuator in frictional engagement with said movable means and partially contained within said housing means and operable to move said movable means solely as a result of said frictional engagement, said means for actuating being movable relative to said movable means when movement of said movable means is resisted.

2. The switch assembly described in claim 1 wherein said movable means for establishing electrical connection comprises a friction piece mounted on said means for actuating and includes means whereby one of said contacts may be moved with said friction piece.

3. The switch assembly of claim 1 wherein said contacts comprise parts of a conventional switch mounted to said housing.

4. A floating operating and release point switch comprising:

a housing;

at least first and second electrical contacts contained within said housing;

a contact member for establishing electrical connection between said first and second electrical contacts and contained within a cavity in said housing;

a movable friction piece mounting said contact member for movement within said cavity; and a plunger extending through said friction piece in frictional, but slidable, engagement therewith, said plunger extending exteriorly of said housing and carrying said friction piece for movement therewith to establish said electrical connection between said first and second electrical contacts as a result of said frictional engagement, and allowing said friction piece to slide relative to said plunger against said frictional engagement when movement of said friction piece is resisted.

5. The switch assembly described in claim 4 wherein said friction piece is attached to a central opening in said contact number, said friction piece also having a substantially central opening with said plunger extending through the same.

6. The switch assembly described in claim 5 wherein said plunger is slightly larger than said friction piece central opening to thereby provide said friction but slidable, engagement.

7. A switch actuator for providing a floating operating and release point switch assembly comprising:

a base;

a plunger having an exposed operating end mounted for movement in said base;

means for mounting relatively movable switch contacts to said base; and a friction piece normally frictionally grasping said plunger as to be movable therewith and relatively movable with respect to the plunger when movement of said friction piece is resisted;

said friction piece being oriented with respect to said mounting means such that movement of said friction piece may effect relative movement between relatively movable switch contacts mounted to said base by said mounting means as a result of said frictional grasping.

8. The switch actuator of claim 7 wherein said friction piece has a surface somewhat tightly embracing said plunger.

9. The switch actuator of claim 8 wherein said surface is defined by a hole in said friction piece through which said plunger extends, said hole being slightly smaller than said plunger.

10. A switch construction having floating operating and release points, comprising:

a base;

a contact assembly on said base and comprising at least two relatively movable electrical switch contacts, said contacts being relatively movable between open and closed positions;

an actuator movably mounted on said base and having an exposed section adapted to receive an actuating force which in turn moves said actuator in a predetermined direction on said base;

means, including a return spring operatively interposed between said base and said actuator, for biasing said actuator oppositely of said actuating force;

an operator independent of said biasing means for said relatively movable switch contacts and movable with respect to said base so as to effect said relative movement between said switch contacts; and means interconnecting said acutuator and said operator independently of said spring and establishing a tight frictional coupling between said actuator and said operator so that movement of said actuator by said actuating force or said biasing means will effect movement of said operator to, in turn, effect said relative movement of said electrical switch contacts due to said frictional coupling and so that said operator may slip relative to said actuator as said actuator continues to move when a resistive force greater than any force required to effect said relative movement of said electrical switch contacts is applied to said operator.

11. The switch construction of claim 10 wherein said spring is a compression coil spring having one end engaging said base and another end connected to said actuator; and said actuator is a plunger mounted for reciprocating movement on said base.

12. The switch construction of claim 10 wherein said contact assembly is a conventional switch mounted to said base in a position to be engaged by said operator.

* * * * *